US005094631A

United States Patent [19]

Suzuki

[11] Patent Number: 5,094,631

[45] Date of Patent: Mar. 10, 1992

[54] MODULAR JACK

[75] Inventor: Akio Suzuki, Tokyo, Japan

[73] Assignee: Hirose Electric Co., Ltd., Tokyo, Japan

[21] Appl. No.: 666,614

[22] Filed: Mar. 8, 1991

[51] Int. Cl.[5] ..... H01R 13/00

[52] U.S. Cl. ..... 439/676

[58] Field of Search ..... 439/676

[56] References Cited

U.S. PATENT DOCUMENTS

| | | | |
|---|---|---|---|
| 4,210,376 | 7/1980 | Hughes et al. | 439/676 |
| 4,457,570 | 7/1984 | Bogese, II | 439/676 |
| 4,501,464 | 2/1985 | Bogese, II | 439/676 |
| 4,717,217 | 1/1988 | Bogese, II | 439/65 |
| 4,734,043 | 3/1988 | Emert et al. | 439/65 |

*Primary Examiner*—Joseph H. McGlynn
*Attorney, Agent, or Firm*—Kanesaka & Takeuchi

[57] ABSTRACT

A modular jack which includes a jack housing (10) made from a dielectric material such that it has a plug receiving opening (11) on a front side (10*a*) and a plurality of stopper projections (12) on a rear side (10*b*); and a plurality of jack terminals (20) made from a wire having a torsion spring characteristic and press fitted into the jack housing through the rear side and bent outwardly at press fit base portions so that they are held in place by the stopper projections with the torsion spring characteristic of the jack terminals.

3 Claims, 3 Drawing Sheets

MODULAR JACK

BACKGROUND OF THE INVENTION

1. Field of the Invention

The present invention relates to modular jacks for electronic communications connecters or the like and methods of broadening the pitch of jack terminals.

2. Description of the Prior Art

FIG. 7 shows a conventional a modular jack for electronic communications connectors. The modular jack includes a jack housing 1 made from a dielectric material, such as a synthetic resin, and a number of jack terminals 2 assembled into the jack housing 1. The jack housing 1 has a plug opening 3 into which a plug (not shown) is to be inserted. The contact portions of the jack terminals 2 are press fitted into the jack housing 1 such that they are aligned side by side with a small pitch and come into contact with the plug terminals. The connection portions of the jack terminals 2 project from the jack housing 1 with a relatively large pitch so that it is easy to solder or bolt them. For these reasons, a number of terminal grooves 4 have been provided on the top 1*a* of the jack housing 1 in such a manner as shown in FIG. 7. See Japanese Patent Application Kokoku No. 63-46536.

As FIG. 8 shows, it has also been proposed to stamp the jack terminals 2 such that they have a contact portion 2*a* which is aligned with a small pitch and a connection portion 2*b* which is aligned with a large pitch.

However, with the structure of FIG. 7, it is necessary to assemble the jack terminals one by one, resulting in the decreased productivity. With the structure of FIG. 8, the amount of material waste is so large that the manufacturing costs are increased.

SUMMARY OF THE INVENTION

Accordingly, it is an object of the invention to provide a modular jack with which it is easy to assemble jack terminals, thereby increasing the productivity.

It is another object of the invention to provide a modular jack which is easy and economical to make.

It is still another object of the invention to provide a method of broadening the pitch of jack terminals.

According to an aspect of the invention there is provided a modular jack which includes a jack housing made from a dielectric material such that it has a plug receiving opening on a front side and a plurality of stopper projections on a rear side; and a plurality of jack terminals made from a wire having a torsion spring characteristic and press fitted into the jack housing through the rear side and bent outwardly at press fit base portions so that they are held in place by the stopper projections with the torsion spring characteristic of the jack terminals.

According to another aspect of the invention there is provided a method of broadening a pitch of jack terminals, which includes the steps of press fitting wire contacts having a torsion spring characteristic into a jack housing so that the wire contacts are aligned side by side with a small pitch; and bending the wire contacts outwardly at press fit base portions so that the wire contacts are held with a predetermined pitch by stopper projections provided on a rear side of the jack housing.

A plurality of jack terminals are press fitted into the jack housing side by side and bent outwardly so that they are held in place by the stopper projections with a predetermined pitch. In addition, the jack terminals are made from wire contacts having a torsion spring characteristic which is used for holding the jack terminals at desired angles so that it is possible to work the jack terminals with a small pitch.

The above and other objects, features, and advantages of the invention will be more apparent from the following description when taken in conjunction with the accompanying drawings.

DESCRIPTION OF THE PREFERRED EMBODIMENT

Figure 1:
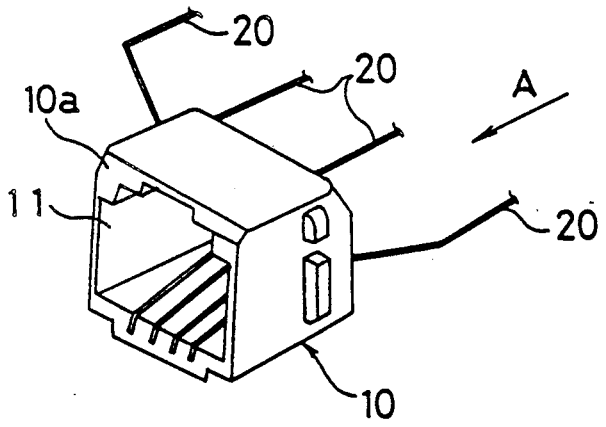
FIG. 1 is a perspective view of a modular jack according to an embodiment of the invention.
Figure 2:
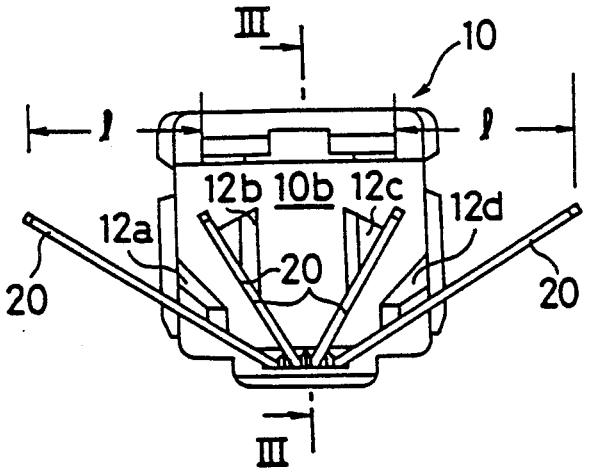
FIG. 2 is the modular jack as viewed from an arrow A of FIG. 1.
Figure 3:
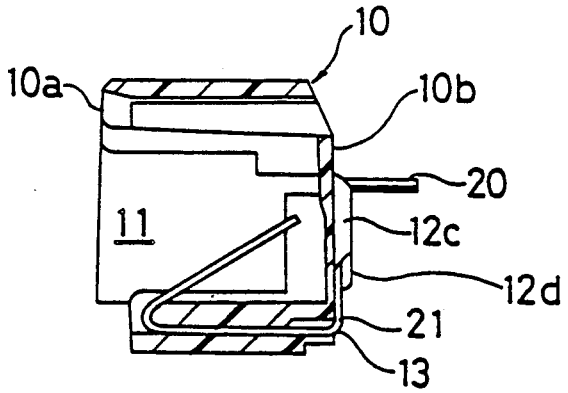
FIG. 3 is a sectional view taken along the line III—III of FIG. 2.

In FIGS. 1–3, the modular jack includes a jack housing 10 which is made from a dielectric material, such as a synthetic resin, and four jack terminals 20 which are assembled into the jack housing 10.

The jack housing 10 has on a front side 10*a* a plug receiving opening 11 for receiving a plug (not shown) and on a rear side 10*b* four stopper projection 12*a*, 12*b*, 12*c*, and 12*d* (FIG. 2). These stopper projections 12*a*, 12*b*, 12*c*, and 12*d* have a sloped inner or upper side.

Each jack terminal 20 is made from a wire contact which has a torsion spring characteristic. Four such jack terminals 20 are assembled in the jack housing 10 by press fitting through terminal apertures 13 provided a lower portion of the rear side 10*b* and diagonally bending the front contact portions as shown in FIG. 3.

Figure 6:
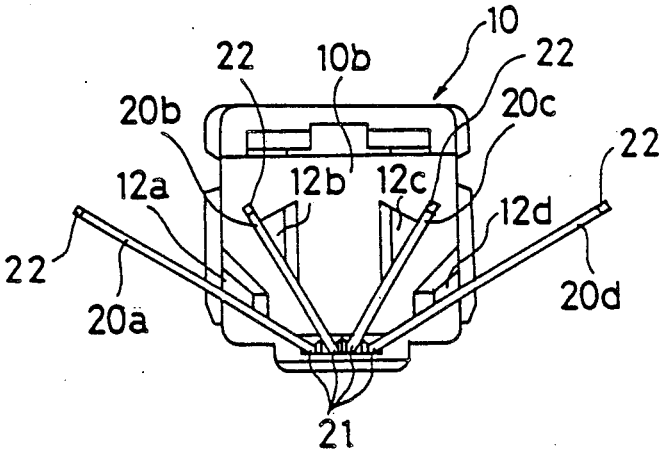
FIG. 6 is a rear view of the jack housing after the jack terminals are bent outwardly.
Figure 7:
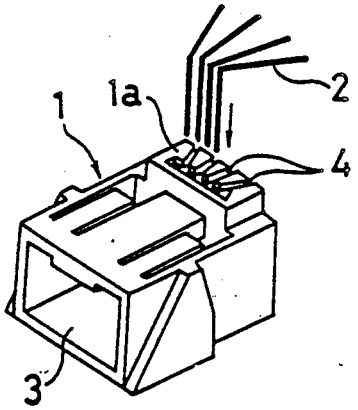
FIG. 7 PRIOR ART
FIG. 7 is a perspective view of a conventional modular jack.
Figure 8:
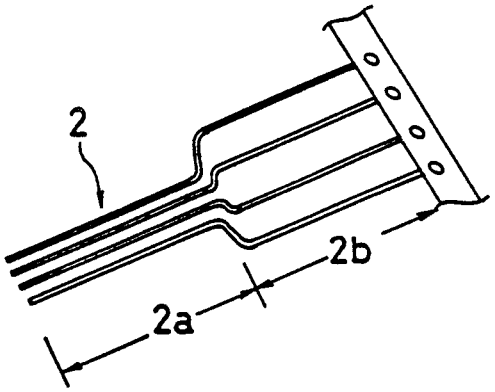
FIG. 8 PRIOR ART
FIG. 8 is a plan view of conventional jack terminals.

The rear connection portions of the jack terminals 20 are bent at press fit base portions 21 upwardly by about 90 degrees and then outwardly about 90 degrees. As best shown in FIG. 2, the respective jack terminals 20 are bent outwardly about the press fit base portions 21 and abut on the outer or lower side of the stopper projections 12*a*, 12*b*, 12*c*, and 12*d*. The jack terminals 20 tend to return to the original positions, producing large springy forces against the stopper projections 12 which hold the jack terminals 20 in place with a pitch 1. The lengths of the respective terminals 20 are set so that their tips 22 are substantially level with each other (FIG. 6).

As has been described above, according to the invention, the jack terminals 20 made from wire contacts which have a torsion spring characteristic are press fitted into the jack housing 10 and bent outwardly about the press fit base portions 21 and held in place by the stopper projections 12. As a result, in contrast to the conventional modular jacks in which jack terminals are assembled into the grooves one by one, it is possible to press fit a group of jack terminals into the jack housing at once, thereby improving the assembling operation very much. In addition, the wire contacts are stamped parallel with a small pitch so that there is little material waste, thus reducing manufacturing costs.

A method of broadening the pitch of the jack terminals 20 is described below with reference to FIGS. 4–6.

Figure 4:
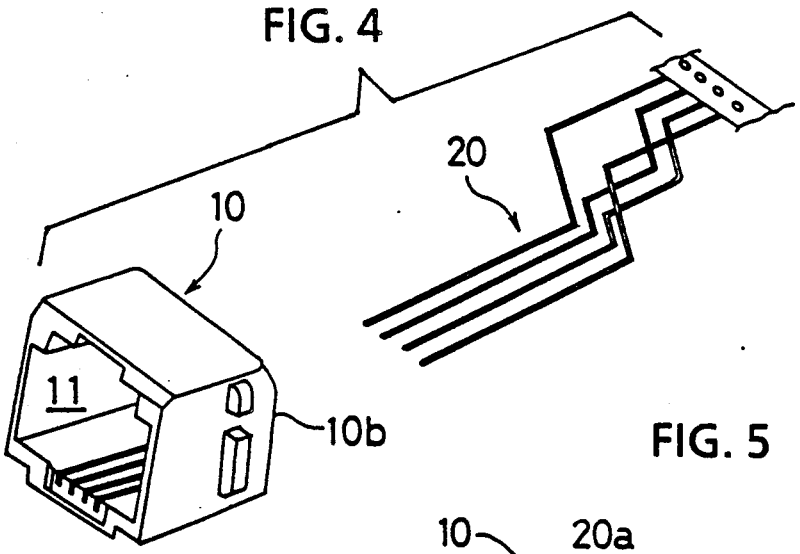
FIG. 4 is an exploded perspective view of a jack housing and jack terminals.

As FIG. 4 shows, the jack terminals 20 are press fitted into the jack housing 10 through the terminal apertures 13 on the rear side 10*b*. At this point, the jack terminals 20 have a small pitch for contact with the terminals of a mating plug.

Figure 5:
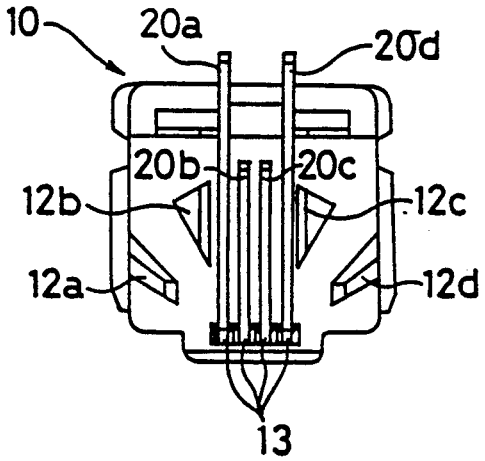
FIG. 5 is a rear view of the jack housing before the jack terminals are bent outwardly.

As FIG. 5 shows, the respective jack terminals 20*a*, 20*b*, 20*c*, and 20*d* are then cut to predetermined lengths.

As FIG. 6 shows, the jack terminals 20*a* and 20*b* are bent to the left side while the jack terminals 20*c* and 20*d* are bent to the right side so that they abut on the respective stopper projections 12*a*, 12*b*, 12*c*, and 12*d*. The respective jack terminals 20 are held in place by the stopper projections 12 with their own returning spring force such that the tips 22 of the jack terminals 20 are aligned with a predetermined pitch.

By stamping and assembling jack terminals in this way, it is possible to reduce material waste. By changing the positions of stopper projections 12, it is possible to change the pitch of jack terminals 20.

I claim:

1. A modular jack comprising:

a jack housing made from a dielectric material such that it has a plug receiving opening on a front side and a plurality of stopper projections on a rear side, and a plurality of press-fit apertures provided across said front side and said rear side; and a plurality of jack terminals made from a wire having a torsion spring characteristic so as to have a diagonally bent front contact portion, a horizontal press-fit base portion, and a rear connection portion extending first upwardly from said press-fit base portion along said rear side and then horizontally and outwardly from said rear side, with said press-fit base portion being press fitted into said press-fit apertures to fixedly retain said jack terminals and said rear connection portions being forcibly flared at said press-fit base portion to such an extent that they are held in place by said stopper projections with said torsion spring characteristic of said jack terminals.

2. The modular jack of claim 1, wherein said projections has a sloped inner or upper side so that it is easy to forcibly flare said rear connection portions over said stopper projections.

3. A method of broadening a pitch of jack terminals, which comprises the steps of:

press fitting front contact and press-fit base portions of a plurality of wire contacts having a torsion spring characteristic into press-fit apertures of a jack housing so that said front contact and press-fit base portions of said wire contacts are fixedly aligned within said jack housing side by side with a small pitch; and forcibly flaring rear connection portions at said press-fit base portions such an extent that said rear connection portions of said wire contacts are held in place with a predetermined large pitch by stopper projections provided on a rear side of said jack housing with said torsion spring characteristic of said wire contacts.

* * * * *